US006925351B2

(12) United States Patent
Larson

(10) Patent No.: US 6,925,351 B2
(45) Date of Patent: Aug. 2, 2005

(54) METHOD AND SYSTEM FOR UPDATING STITCH DATA IN A MEMORY CARD VIA A WIRELESS TRANSMISSION

(75) Inventor: Timothy E. Larson, Argyle, TX (US)

(73) Assignee: Action Tapes, Inc., Dallas, TX (US)

( * ) Notice: Subject to any disclaimer, the term of this patent is extended or adjusted under 35 U.S.C. 154(b) by 53 days.

(21) Appl. No.: 10/717,367

(22) Filed: Nov. 19, 2003

(65) Prior Publication Data

US 2005/0107905 A1 May 19, 2005

(51) Int. Cl.[7] ..... D05C 5/02
(52) U.S. Cl. ..... 700/138
(58) Field of Search ..... 700/136, 137, 700/138; 112/102.5, 470.06

(56) References Cited

U.S. PATENT DOCUMENTS

| | | | | |
|---|---|---|---|---|
| 5,904,108 A | | 5/1999 | Tanaka et al. | 112/102.5 |
| 5,960,726 A | | 10/1999 | Yamada | 112/102.5 |
| 5,988,083 A | | 11/1999 | Tomita et al. | 112/102.5 |
| 6,095,067 A | | 8/2000 | Tomita et al. | 112/102.5 |
| 6,131,526 A | | 10/2000 | Iida et al. | 112/102.5 |
| 6,202,001 B1 | * | 3/2001 | Muto | 700/138 |
| 6,256,551 B1 | | 7/2001 | Muto | 700/138 |
| 6,289,831 B1 | | 9/2001 | Hanai et al. | 112/102.5 |
| 6,295,481 B1 | * | 9/2001 | Price | 700/136 |
| 6,324,441 B1 | | 11/2001 | Yamada | 700/138 |
| 6,457,429 B1 | * | 10/2002 | Tomita et al. | 112/475.19 |
| 6,543,374 B2 | | 4/2003 | Terao | 112/470.05 |
| 2002/0000181 A1 | | 1/2002 | Mamiya et al. | 112/270 |
| 2002/0007228 A1 | | 1/2002 | Goldman | 700/138 |
| 2002/0014191 A1 | | 2/2002 | Shimizu | 112/475.19 |
| 2002/0029729 A1 | | 3/2002 | Mamiya | 112/2 |
| 2002/0029730 A1 | | 3/2002 | Mamiya | 112/2 |
| 2002/0059891 A1 | | 5/2002 | Shimizu et al. | 112/302 |
| 2002/0066397 A1 | | 6/2002 | Mamiya et al. | 112/470.05 |
| 2002/0078871 A1 | | 6/2002 | Mamiya et al. | 112/475.04 |
| 2004/0083022 A1 | * | 4/2004 | Akira et al. | 700/138 |

* cited by examiner

*Primary Examiner*—Peter Nerbun
*Assistant Examiner*—Brian Kauffman
(74) *Attorney, Agent, or Firm*—Duke W. Yee; Cathrine K. Kinslow

(57) ABSTRACT

The present invention provides a method and system for using a wireless transmission between an embroidery machine and a source system to update stitch data in a memory card. A command to update the stitch data in the memory card is received. Once it is determined that the memory card is not currently in use, the memory card is logically disconnected from the embroidery machine. The new stitch data is then transferred from a source system to the memory card via a wireless connection, and the contents of the memory card are updated with the new stitch data. The memory card is then logically reconnected to the embroidery machine and the new stitch data is ready to be used by the embroidery machine.

20 Claims, 3 Drawing Sheets

METHOD AND SYSTEM FOR UPDATING STITCH DATA IN A MEMORY CARD VIA A WIRELESS TRANSMISSION

BACKGROUND OF THE INVENTION

1. Technical Field

The present invention relates generally to an improved method and system for transferring data to a sewing/embroidery system. In particular, the present invention relates to a method and system for using wireless transmission between a sewing/embroidery machine and a source system to update stitch information in a memory card.

2. Description of Related Art

Advances in computer technology have provided the embroidery and sewing machine market with various methods to transfer embroidery designs to an embroidery or sewing machine. Embroidery designs are employed by the embroidery or sewing machine to guide the machine's movement of the embroidery arm. The embroidery arm is directed to stitch the same pattern specified in the design.

Embroidery designs may be acquired in a variety of ways, including purchasing designs stored on floppy disks and CD-ROMs, or downloading designs from the Internet and storing the designs on a computer's hard drive. The embroidery design is then typically supplied to the embroidery or sewing machine via a data storage device, such as a memory card or floppy disk. The memory card or floppy disk is typically inserted into a built-in embroidery card slot within the embroidery machine, which reads the contents of the card and is then able to stitch the designs stored on the card.

Current methods for transferring designs obtained from a source such as a PC's hard drive to an embroidery machine include storing these designs on a blank memory card and transferring the designs to the embroidery machine in the same manner as describe above.

However, conventional methods for updating the stitch data available to the embroidery machine can be cumbersome. For example, the content of the memory card or floppy disk is updated with desired stitch data via a PC or other source system. Next, the updated card or disk is physically carried from the source system to the embroidery machine. The updated card or disk is interfaced with the embroidery machine and the desired stitch information is then available for use. Since these steps are performed each time new stitch information is desired, changing stitch data available to the embroidery machine can be a time-consuming process.

In addition, although some conventional embroidery machines include the ability to directly connect to the PC, the addition of this interface method to the embroidery machine requires that the machine software be extensively modified or designed from the ground up prior to implementing this peer-to-peer protocol.

Therefore, it would be advantageous to have an improved method and system for updating stitch data available to an embroidery machine.

SUMMARY OF THE INVENTION

The present invention provides a method and system for using a wireless transmission between an embroidery machine and a source system to update stitch data in a memory card. A command to update the stitch data in the memory card is received. Once it is determined that the memory card is not currently in use, the memory card is logically disconnected from the embroidery machine. The new stitch data is then transferred from a source system to the memory card via a wireless connection, and the contents of the memory card are updated with the new stitch data. The memory card is then logically reconnected to the embroidery machine and the new stitch data is ready to be used by the embroidery machine.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

The present invention provides a method and system for transferring embroidery designs from a source system to an embroidery machine via a wireless connection. The present invention may be implemented using a stand-alone embroidery machine, a combination sewing/embroidery machine, or any other device which employs stitch data instructions. The present invention may also be implemented using a source system, such as, for example, a personal computer (PC) or a personal digital assistant (PDA) device.

Figure 1:
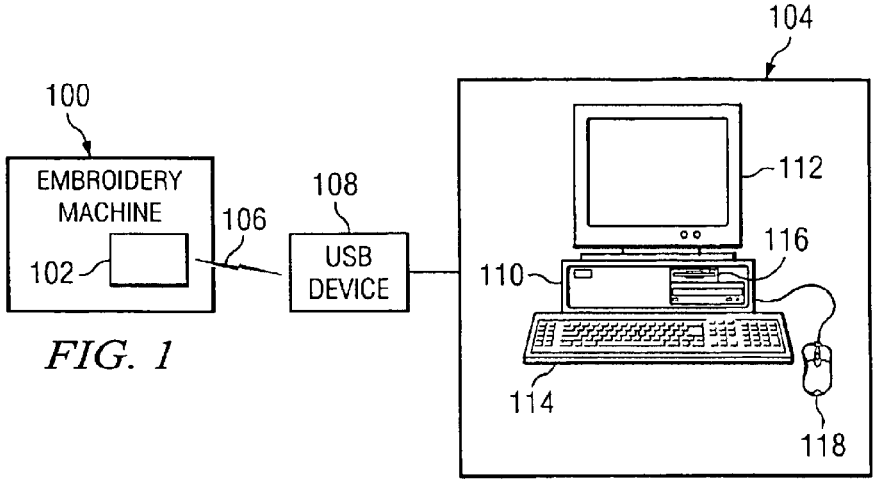
FIG. 1 is a pictorial representation of an embroidery system in which the present invention may be implemented in accordance with a preferred embodiment of the present invention.

With reference now to the figures and in particular with reference to FIG. 1, a pictorial representation of an embroidery system in which the present invention may be implemented is depicted in accordance with a preferred embodiment of the present invention. An embroidery machine 100 is depicted which includes a built-in memory card slot 102. Embroidery machine 100 is connected to computer 104 via a wireless connection 106. USB device 108 provides the interface between embroidery machine 100 and computer 104. Computer 104 is depicted which includes system unit 110, video display terminal 112, keyboard 114, storage devices 116, which may include floppy drives and other types of permanent and removable storage media, and mouse 118. Additional or alternate input devices may be included with personal computer 104, such as, for example, a joystick, touchpad, touch screen, trackball microphone, and the like. Computer 104 can be implemented using any suitable computer, such as an IBM eServer™ computer or IntelliStation™ computer, which are products of International Business Machines Corporation, located in Armonk, N.Y. Although the depicted representation includes a computer, other embodiments of the present invention may be implemented in other types of data processing systems, such as a network computer. Computer 104 also preferably includes a graphical user interface (GUI) that may be implemented by means of systems software residing in computer readable media in operation within computer 104.

Figure 2:
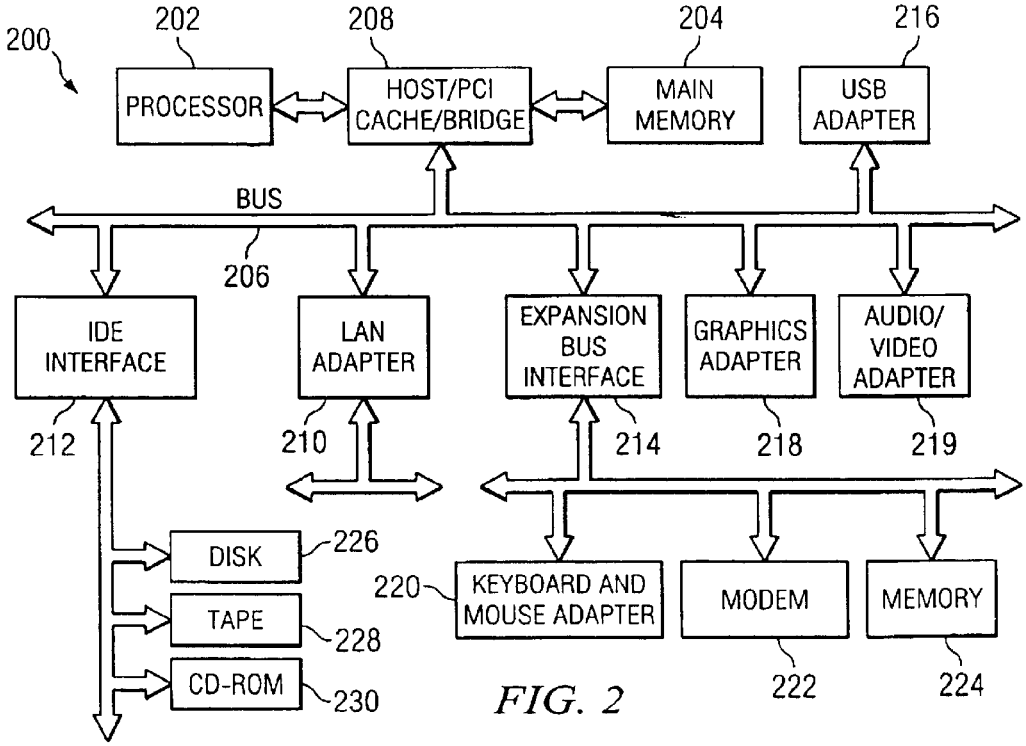
FIG. 2 is a block diagram of a data processing system in which the present invention may be implemented.

With reference now to FIG. 2, a block diagram of a data processing system is shown in which the present invention may be implemented. Data processing system 200 is an example of a computer, such as computer 100 in FIG. 1, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, Intelligent Drive Electronics (IDE) interface 212, and expansion bus interface 214 are connected to PCI local bus 206 by direct component connection. In contrast, USB adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. IDE interface 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as Windows XP™, which is available from Microsoft Corporation. An object oriented programing system such as Java™ may run in conjunction with the operating system and provides calls to the operating system from Java™ programs or applications executing on data processing system 200. "Java" is a trademark of Sun Microsystems, Inc. Instructions for the operating system, the object-oriented programing system, and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash read-only memory (ROM), equivalent nonvolatile memory, or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include IDE interface 212, hard disk drive 226, tape drive 228, and CD-ROM 230. In that case, the computer, to be properly called a client computer, includes some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a personal digital assistant (PDA), which is configured with ROM and/or flash ROM to provide non-volatile memory for storing operating system files and/or user-generated data.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

Figure 3:
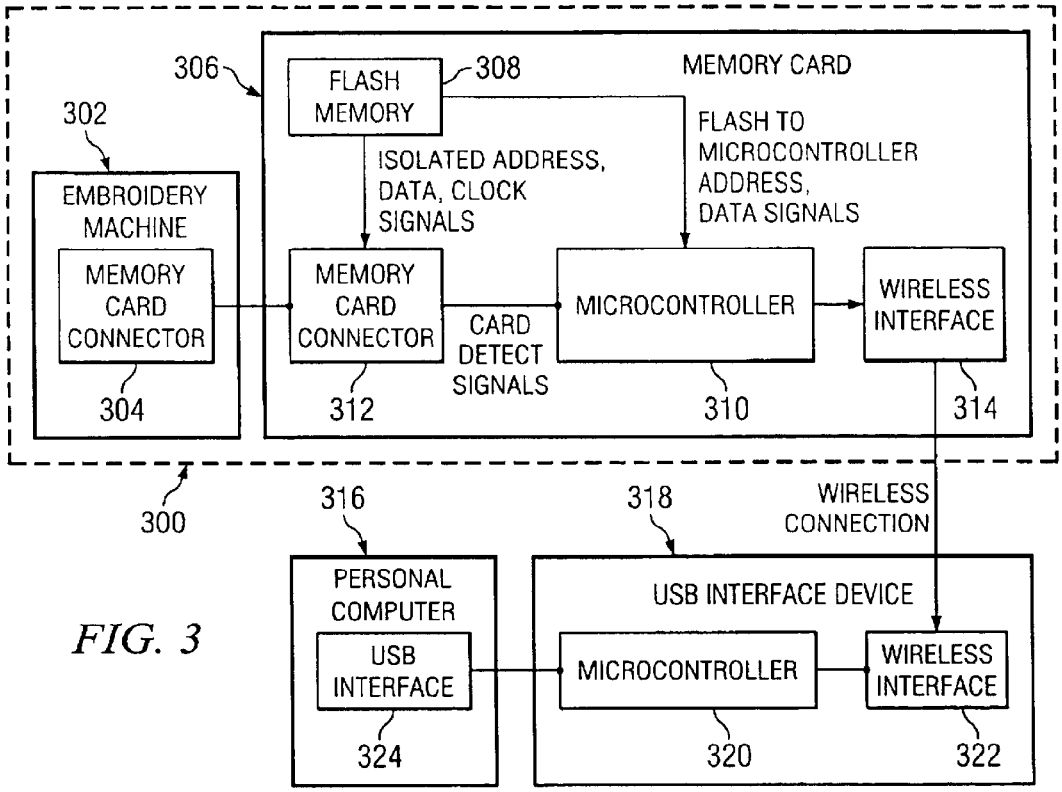
FIG. 3 is a block diagram showing a wireless stitch data update system in accordance with a preferred embodiment of the present invention.

Turning now to FIG. 3, a block diagram illustrating components used in transferring data from a source system, such as data processing system 200 in FIG. 2, to an embroidery machine system via a wireless connection are depicted in accordance with a preferred embodiment of the present invention. In this example, embroidery machine system 300 includes an embroidery machine 302 and memory card 306. Embroidery machine 302 includes a memory card connector 304. Memory card connector 304 provides the interface between embroidery machine 302 and the memory card 306 housing the embroidery designs. In particular, memory card connector 304 handles the transfer of data received from the memory card using any known wireless transmission method. Wireless transmission methods may include, for example, line of sight transmission such as infrared (IR) signal transmissions, and broadcast transmissions such as radio frequency (RF) and Blue Tooth™ transmissions. Although the receiving machine in this example is embroidery machine 302, the receiving machine can be any device that employs stitch information, depending on the particular implementation.

Memory card 306, also known as a flash memory card, is used to store data for use on embroidery machine 302. In this example, memory card 306 includes a flash memory 308, a microcontroller 310, a memory card connector 312, and a wireless interface 314. Memory card connector 312 may be a built-in memory card slot within embroidery machine 302, or a connection to a memory card module located external to embroidery machine 302. Inserting memory card 306 into a built-in memory card slot within embroidery machine 302 allows the embroidery machine to access the stitch data via memory card connector 312. Embroidery machine 302 is then able to use the stitch data on memory card 306 in flash memory 308.

Personal computer (PC) 316 is connected to memory card 306 via a wireless connection. USB interface device 318 is connected to personal computer 316 through USB interface 324, such as USB adapter 216 shown in FIG. 2. It should be noted that although this example implementation employs a USB device, other interface mechanisms may be used, including, for example, IEEE1394, PCCard (PCMCIA), compact PCMCIA, PCI, or any other expansion bus interface card. USB interface device 318 facilitates the wireless connection between memory card 306 and personal computer (PC) 316. USB interface device 318 includes microcontroller 320 and wireless interface 322. Stitch data may be transferred from PC 316 to memory card 306 via the wireless connection. Thus, memory card 306 is updated to reflect the new stitch data from PC 316 while memory card 306 is located within the built-in memory card or within a memory card module located external to embroidery machine 302. Consequently, embroidery machine 302 is able to access new stitch on updated memory card 306.

Figure 4:
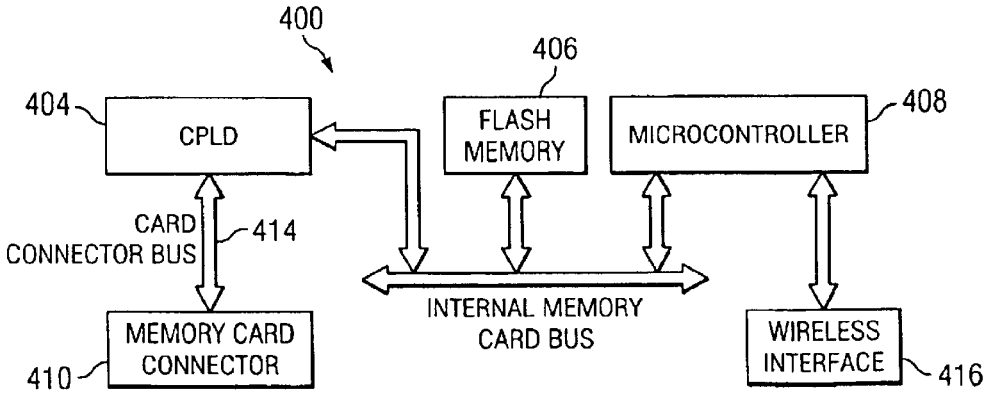
FIG. 4 is a block diagram illustrating a memory card in accordance with a preferred embodiment of the present invention.

Referring now to FIG. 4, a block diagram illustrating components used within a memory card, such as memory card 306 in FIG. 3, in accordance with a preferred embodiment of the present invention. In this preferred implementation, memory card 400 includes internal memory card bus 402 connected to complex programmable logic device (CPLD) 404, flash memory 406, and microcontroller 408. Memory card 400 also includes memory card connector 410 connected to complex programmable logic device (CPLD) 404 via card connector bus 414, and wireless interface 416 connected to microcontroller 408. It should be noted that any logic device, such as a field programmable gate array (FPGA) or application specific integrated circuit (ASIC), may be used in place of complex programmable logic device (CPLD) 404 or microcontroller 408. Transmission methods of wireless interface 416 may include line of sight transmission and broadcast transmission.

Figure 5:
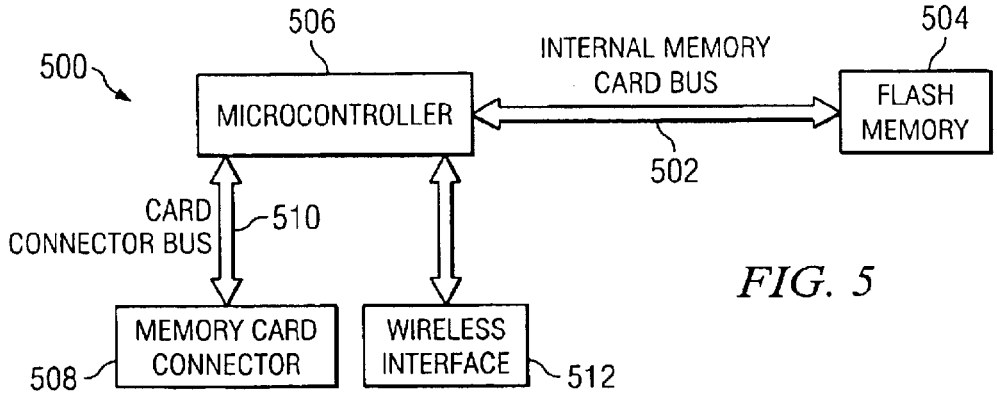
FIG. 5 is a block diagram illustrating a memory card in accordance with an alternative embodiment of the present invention.

An alternative embodiment of memory card 306 in FIG. 3 is depicted in FIG. 5. Memory card 500 includes internal memory card bus 502 connected to flash memory 504 and microcontroller 506. Memory card 500 also includes memory card connector 508 connected to microcontroller 506 via card connector bus 510, and wireless interface 512 connected to microcontroller 506. As stated above, any logic device, such as a field programmable gate array (FPGA) or application specific integrated circuit (ASIC), may be used in place of microcontroller 506. In addition, transmission methods of wireless interface 512 may include line of sight transmission and broadcast transmission.

As mentioned previously, the mechanism of the present invention allows for the wireless transfer of stitch data from a source system to an embroidery machine, and the subsequent update of the contents in memory, such as flash memory 308 in memory card 306. The present invention also eliminates the need for modifying the embroidery machine software to accommodate this peer-to-peer protocol.

Figure 6:
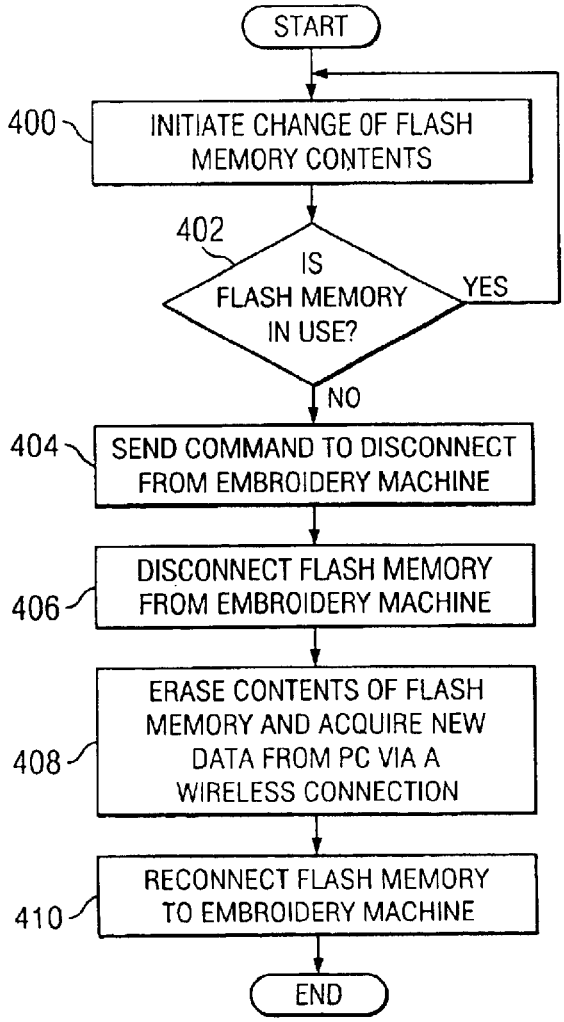
FIG. 6 is a flowchart illustrating a process in the logical design in accordance with a preferred embodiment of the present invention.

Turning now to FIG. 6, a flowchart of a process of transferring embroidery designs is depicted in accordance with a preferred embodiment of the present invention. The process illustrated in FIG. 6 may be initiated by the source system, such as computer 100 in FIG. 1, or the process may be initiated by the stitching device, such as embroidery machine 302 in FIG. 3. The processes illustrated in this example are implemented using a wireless connection between the embroidery machine and the stitch source system.

The process begins by initiating a change in the contents of the flash memory (step 600). The process may be initiated by a PC, such as computer 100 in FIG. 1, or the process may be initiated by the embroidery machine itself. Next, a determination is made as to whether the flash memory is currently in use (step 602). For example, the microcontroller within the memory card may detect data signals generated from the flash memory to determine if the flash memory is in use. If the flash memory is in use, the process returns to step 600.

Otherwise, a command is sent to effectively disconnect the memory card from the embroidery or sewing machine by signaling the various card detect signals accordingly (step 604). In response, the memory card microcontroller disconnects the flash memory from the embroidery machine memory card connector (step 606). This step may be accomplished by pushing a high z from the CPLD to the embroidery machine card connector.

Next, the memory card microcontroller erases the data stored in the flash memory, reprograms itself as necessary to acquire data from the PC wireless interface, and receives the new data (step 608). The memory card microcontroller then reconnects the flash memory to the embroidery machine memory card connector by signaling the various card detect signals accordingly (step 610). At this time, the embroidery or sewing machine may use the new design data stored in the flash memory.

In this manner, the present invention provides an improved method and system for transferring data to a sewing/embroidery system. The advantages of the present invention should be apparent in view of the detailed description provided above. The mechanism of the present invention allows for the wireless transmission of stitch data from a source system to an embroidery machine. The memory card containing stitch data is updated with new stitch data received from the source system. The stitch data is then made available to the embroidery machine. Consequently, new stitch data may be transferred to an embroidery machine without the need for physically carrying the memory card from the source system to the embroidery machine. In addition, there is no need to alter or redesign the software in the embroidery or sewing machine, since the present invention is implemented using existing connections and interfaces on the machines.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method for updating stitch data in a storage device using a wireless connection, comprising:

receiving a command to update the stitch data in the storage device;

determining if the storage device is currently in use;

logically disconnecting the storage device from a stitching device;

transferring new stitch data from a source system to the storage device via a wireless connection;

updating the stitch data in the storage device with the new stitch data; and reconnecting the storage device to the stitching device.

2. The method of claim 1, wherein the storage device is a memory card.

3. The method of claim 2, wherein the memory card includes a programmable logic device, flash memory, memory card connector, and a wireless interface.

4. The method of claim 1, wherein the stitching device is an embroidery machine.

5. The method of claim 1, wherein the stitching device is a sewing machine.

6. The method of claim 1, wherein the command to update the stitch data in the storage device is generated by the source system.

7. The method of claim 1, wherein the command to update the stitch data in the storage device is generated by the stitching device.

8. The method of claim 1, wherein determining if the storage device is currently in use comprises:

detecting data signals generated from a flash memory within the storage device.

9. The method of claim 1, wherein updating the stitch data in the storage device with the new stitch data includes erasing the contents of the storage device and storing the new stitch data in the storage device.

10. The method of claim 1, wherein the wireless connection is at least one of a line of sight or broadcast transmission.

11. A system for updating stitch data in a storage device using a wireless connection comprising:

a stitching device;

a storage device connected to the embroidery machine; and a source system having stitch data, wherein the stitch data is transferred to the storage device in response to a command to update the stitch data in the storage device via a wireless connection, and wherein the stitch data in the storage device is updated by;

determining if the storage device is currently in use;

logically disconnecting the storage devices from a stitching device;

transferring new stitch data from a source system to the storage device via a wireless connection;

updating the stitch data in the storage device with the new stitch data; and reconnecting the storage device to the stitching device.

12. The system of claim 11, wherein the storage device is a memory card.

13. The system of claim 12, wherein the memory card includes a programmable logic device, flash memory, memory card connector, and a wireless interface.

14. The system of claim 11, wherein the stitching device is an embroidery machine.

15. The system of claim 11, wherein the stitching device is a sewing machine.

16. The system of claim 11, wherein the command to update the stitch data in the storage device is generated by the source system.

17. The system of claim 11, wherein the command to update the stitch data in the storage device is generated by the stitching device.

18. The system of claim 11, further comprising:

determining if the storage device is currently in use by detecting data signals generated from a flash memory within the storage device.

19. The system of claim 11, wherein updating the stitch data in the storage device includes erasing the contents of the storage device and storing new stitch data in the storage device.

20. The system of claim 11, wherein the wireless connection is at least one of a line of sight or broadcast transmission.

* * * * *

UNITED STATES PATENT AND TRADEMARK OFFICE

CERTIFICATE OF CORRECTION

PATENT NO. : 6,925,351 B2
DATED : August 2, 2005
INVENTOR(S) : Larson

It is certified that error appears in the above-identified patent and that said Letters Patent is hereby corrected as shown below:

Column 7,
Line 17, after "by" delete ";" and insert -- : --.
Line 19, after "storage" delete "devices" and insert -- device --.

Signed and Sealed this

Third Day of January, 2006

JON W. DUDAS
*Director of the United States Patent and Trademark Office*